US011745257B2

(12) United States Patent
Fukunaga et al.

(10) Patent No.: US 11,745,257 B2
(45) Date of Patent: Sep. 5, 2023

(54) NOZZLE, AND NOZZLE AND STOPPER COMBINATION

(71) Applicant: KROSAKIHARIMA CORPORATION, Fukuoka (JP)

(72) Inventors: Shinichi Fukunaga, Fukuoka (JP); Kouichi Tachikawa, Fukuoka (JP); Toshio Kaku, Fukuoka (JP)

(73) Assignee: KROSAKIHARIMA CORPORATION, Fukuoka (JP)

( * ) Notice: Subject to any disclaimer, the term of this patent is extended or adjusted under 35 U.S.C. 154(b) by 90 days.

(21) Appl. No.: 17/431,214

(22) PCT Filed: Mar. 4, 2020

(86) PCT No.: PCT/JP2020/009058
§ 371 (c)(1),
(2) Date: Aug. 16, 2021

(87) PCT Pub. No.: WO2020/184320
PCT Pub. Date: Sep. 17, 2020

(65) Prior Publication Data

US 2022/0111436 A1 Apr. 14, 2022

(30) Foreign Application Priority Data

Mar. 12, 2019 (JP) ..... 2019-044562

(51) Int. Cl.
*B22D 41/58* (2006.01)
*B22D 41/16* (2006.01)

(52) U.S. Cl.
CPC ..... *B22D 41/58* (2013.01); *B22D 41/16* (2013.01)

(58) Field of Classification Search
CPC ..... B22D 41/58; B22D 41/16
See application file for complete search history.

(56) References Cited

U.S. PATENT DOCUMENTS 3,253,307 A * 5/1966 Griffiths ..... B22D 11/18 222/603

FOREIGN PATENT DOCUMENTS

JP H06182528 A 7/1994
JP 6-297118 A 10/1994
(Continued)

OTHER PUBLICATIONS

International Preliminary Report on Patentability, dated Aug. 25, 2021, with Written Opinion for PCT/JP2020/009058 (English translation).

(Continued)

*Primary Examiner* — Scott R Kastler
(74) *Attorney, Agent, or Firm* — Paul D. Bianco; Fleit Intellectual Property Law

(57) ABSTRACT

Provided is a nozzle or a stopper having a gas blowing function, which is capable of preventing irregular breaking to be triggered by a gas outlet or a gas passage path communicated with the gas outlet, or, even in the event of breaking, preventing expansion of the breaking, and a combination of the nozzle and the stopper. The nozzle comprises: a fitting engagement region refractory material layer composed of a fitting engagement region refractory material; a nozzle body composed of a different refractory material from the fitting engagement region refractory material (main body refractory material); and a gas outlet provided in at least one boundary area between the fitting engagement region refractory material layer and the main body refractory material in a surface of the nozzle contactable with molten steel.

11 Claims, 6 Drawing Sheets

(56) References Cited

FOREIGN PATENT DOCUMENTS

| | | | | |
|---|---|---|---|---|
| JP | 9-314292 | A | | 12/1997 |
| JP | H10258342 | A | | 9/1998 |
| JP | 2006-61943 | A | | 3/2006 |
| JP | 2013-184199 | A | | 9/2013 |
| JP | 2014034052 | A | * | 2/2014 |
| JP | 2017-64778 | A | | 4/2017 |

OTHER PUBLICATIONS

International Search Report (dated Mar. 15, 2020) and Written Opinion (dated Apr. 7, 2020) for PCT/JP2020/009058, filed Mar. 4, 2020.

* cited by examiner

Fig. 7A
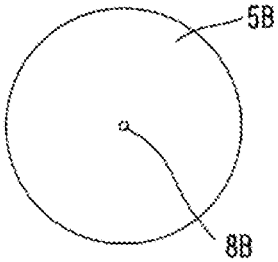
Fig. 7B
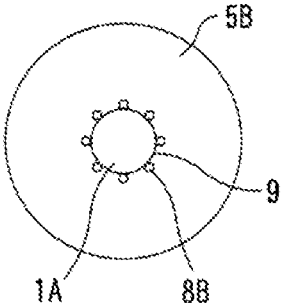
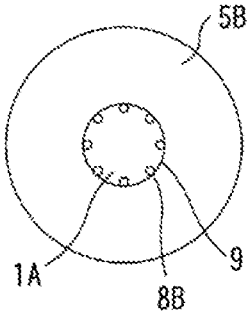
Fig. 7C
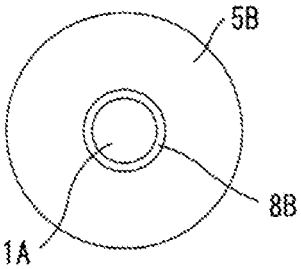
Fig. 7D
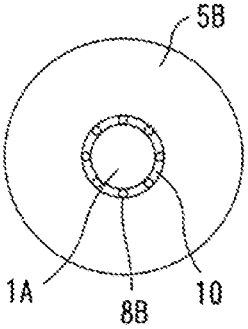
Fig. 7E Fig. 9
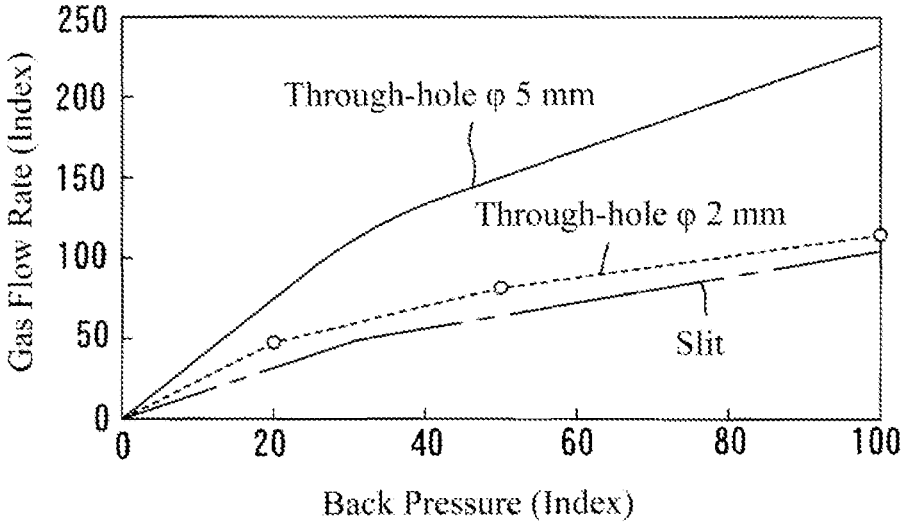
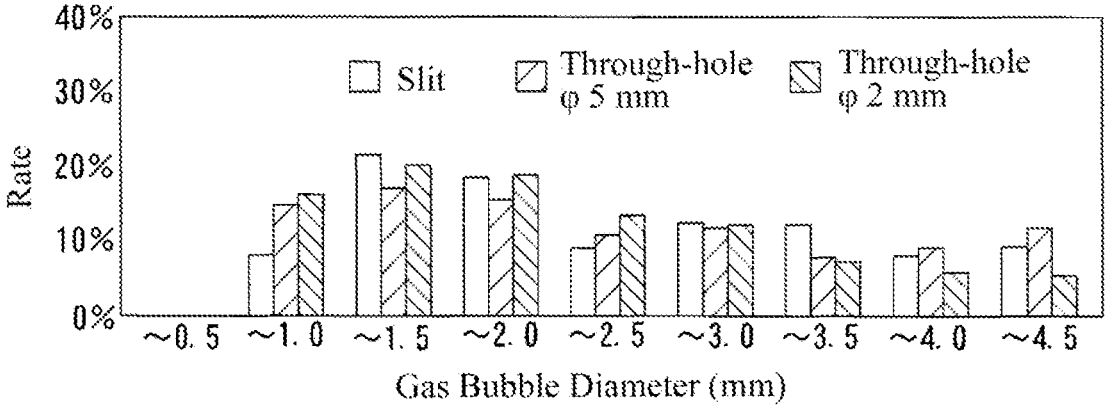
Fig. 10

NOZZLE, AND NOZZLE AND STOPPER COMBINATION

TECHNICAL FIELD

The present invention relates to a continuous casting nozzle (specifically, an immersion nozzle, a tundish nozzle or the like) configured to be fittingly engageable with a stopper mainly for controlling flow rate during discharge of molten steel from a tundish to a casting mold, and a continuous casting nozzle and stopper combination.

As used in this specification, the term "continuous casting nozzle" will hereinafter be referred to simply as "nozzle".

BACKGROUND ART

In continuous casting of molten steel, inclusions such as alumina is likely to adhere to a fitting engagement region including a contact area between a stopper and a nozzle, causing difficulty in flow rate control.

As a measure to prevent inclusions from adhering to the fitting engagement region, for example, the below-mentioned Patent Document 1 discloses a stopper-receiving nozzle provided in the bottom of a tundish, wherein the nozzle comprises two porous refractory members provided to define, respectively, upper and lower molten steel contact surfaces bordered by a contact area with a stopper, so as to allow argon gas to be blown through the porous refractory members, independently.

However, in the case where argon gas is blown through the porous refractory members, problems can arise that: a gas bubble diameter in molten steel becomes excessively large; the flow rate is excessively increased to cause difficulty in flow rate control; and, due to a large area of a gas blowing surface, a blowing amount of gas becomes uneven depending on position of the gas blowing surface and thereby adhesion of inclusions is more likely to occur in a part of the gas blowing surface.

There has also been known a nozzle configured to blow argon gas from a gas outlet other than such a porous refractory member.

For example, with a view to allowing blowing of inert gas to perform from a position close to a pouring hole (nozzle inner bore) while suppressing flow of the inert gas into molten steel in a casting mold, thereby further reducing re-contamination of molten steel after removal of inclusions by inert gas, the below-mentioned Patent Document 2 discloses a continuous casing upper nozzle in which a plurality of gas blowing holes are provided on the circumference of an upper end face of the upper nozzle centered at the center of the pouring hole, wherein a relationship between a total cross-sectional area A ($m^2$) of the gas blowing holes, and a volume Vg ($m^3$) of a flow passage (slit) through which inert gas flows inside the upper nozzle is set in a specific range.

Such a through-hole type nozzle is composed of a refractory material having a denser microstructure than that of a porous refractory material. Thus, as compared with a porous type nozzle, the through-hole type nozzle is superior in terms of corrosion resistance and abrasion resistance, but inferior in terms of thermal shock resistance. Moreover, in some aspects, such a through-hole portion is a "defect" in a structural body, and has the disadvantage that a thermal or mechanical stress is apt to concentrate thereon to trigger breaking of the structural body. Particularly, in a case where start or stop of discharge of molten steel, or flow rate control of molten steel, is performed by operation of fittingly engaging a stopper with an upper end of the inner bore of the nozzle, the stopper operation itself can apply a mechanical external force, such as shock or compressive force, directly to the nozzle, thereby increasing a risk of breaking of the through-hole type nozzle.

With a view to providing a hard-to-break through-hole type nozzle, the below-mentioned Patent Document 3 discloses a nozzle provided with a through-hole penetrating through a nozzle body and communicated with a gas pool, wherein the through-hole is formed in a three-dimensional non-linear shape.

On the other hand, with a view to preventing clogging around an upper nozzle due to inclusions in molten steel, the below-mentioned Patent Document 4 discloses an upper nozzle in which a refractory material having a significant clogging suppression effect is provided at each of an upper end of the upper nozzle contactable with a region where molten steel flows in a contracted manner, and a portion of a stopper head contactable with the upper nozzle, wherein the refractory material is free of C element, and has a high $Al_2O_3$ or MgO content.

CITATION LIST

Patent Document

Patent Document 1: JP-A H06-297118
Patent Document 2: JP-A 2017-064778
Patent Document 3: JP-A 2013-184199
Patent Document 4: JP-A H09-314292

SUMMARY OF INVENTION

Technical Problem

A gas outlet formed as a through-hole or slit is deemed to be a defect in an integrated microstructure of a refractory material, and can trigger breaking of the refractory material due to concentration of a mechanical stress or thermal stress on the defect, or the like, as mentioned above. Further, such breaking will occur in an irregular (random) direction and at an irregular position. If the breaking occurs in a fitting engagement region between a nozzle and a stopper, it is likely to cause a serious problem, e.g., that it becomes unable to control the flow rate or distribution of blowing gas, and further molten steel flow rate control and stopping functions are impaired, thereby becoming unable to maintain normal casting.

Even if the through-hole as a gas outlet or a gas distribution path is formed in a structure which makes it less likely for a stress to concentrate thereon, as in the Patent Document 3, there still remains a risk of causing breaking of the nozzle.

On the other hand, in the case where a peculiar refractory material excellent in corrosion resistance and anti-adhesion property is disposed in a part of the fitting engagement region, as in the Patent Document 4, this refractory material generally has a higher thermal expansibility and a higher elastic modulus than those of the main body refractory material composing a nozzle body improved in terms of thermal shock resistance. If such a peculiar refractory material is installed in contact with the main body refractory material, a risk is increased that it presses and breaks the main body refractory material.

A problem to be solved by the present invention is to provide a nozzle or a stopper having a gas blowing function, which is capable of preventing irregular breaking to be triggered by a gas outlet or a gas passage path communicated with the gas outlet, or, even in the event of breaking, preventing expansion of the breaking, and a combination of the nozzle and the stopper.

Further, another problem to be solved by the present invention is to provide a nozzle capable of, in a case where a refractory material having a higher thermal expansibility than that of a main body refractory material composing a nozzle body of the nozzle is installed in a fitting engagement sub-region with a stopper, preventing irregular breaking of the nozzle body, and a combination of the nozzle and the stopper.

Solution to Technical Problem

The present invention provides a nozzle and a nozzle and stopper combination having features as described in the following sections 1 to 11.

1. A nozzle located beneath a stopper for controlling a flow rate of molten steel in continuous casting of molten steel, and fittingly engageable with the stopper in a fitting engagement region. The nozzle comprises: a fitting engagement sub-region including a contact area with the stopper, the fitting engagement sub-region comprising a layer composed of a refractory material for the fitting engagement region (the layer will hereinafter be referred to as "fitting engagement region refractory material layer");

a nozzle body composed of a refractory material different from the refractory material for the fitting engagement region (hereinafter referred to as "main body refractory material"); and a gas outlet provided in at least one boundary area between the fitting engagement region refractory material layer and the main body refractory material in a surface of the nozzle contactable with molten steel.

2. The nozzle as described in the section 1, wherein the gas outlet is composed of a plurality of through-holes or a slit.

3. The nozzle as described in the section 2, wherein each of the through-holes has a diameter of 2 mm or less, or the slit has a width of 1 mm or less.

4. The nozzle as described in the sections 1 to 3, wherein the refractory material for the fitting engagement region is a refractory material having a carbon content of 5 mass % or less (including zero) (this refractory material will hereinafter be refereed to as "carbonless refractory material").

5. The nozzle as described in the section 4, wherein the carbonless refractory material has a $ZrO_2$ content of 75 mass % or more, and a carbon content of 5 mass % or less (including zero), a remainder mainly consisting of an oxide.

6. The nozzle as described in the section 4, wherein the carbonless refractory material has a spinel ($Al_2O_3 \cdot MgO$) content of 75 mass % or more, and a carbon content of 5 mass % or less (including zero), a remainder mainly consisting of an oxide.

7. The nozzle as described in any one of the sections 1 to 6, wherein the main body refractory material is a refractory material primarily comprising a refractory raw material selected from the group consisting of an alumina-based refractory raw material, an alumina-silica based refractory raw material, a spinel-based refractory raw material, a zircon-based refractory raw material, and a magnesia-based refractory raw material.

8. A nozzle and stopper combination comprising the nozzle as described in any one of the sections 1 to 7, and a stopper, wherein the stopper comprises a gas outlet below a contact area thereof with the nozzle, wherein the gas outlet of the stopper is composed of one or more through-holes or a slit.

9. The nozzle and stopper combination as described in the section 8, wherein each of the through-holes of the stopper has a diameter of 2 mm or less, or the slit of the stopper has a width of 1 mm or less.

10. The nozzle and stopper combination as described in the section 8 or 9, wherein the stopper comprises a fitting engagement sub-region including the contact area with the nozzle, wherein at least a part of the fitting engagement sub-region comprises the fitting engagement region refractory material layer.

11. A nozzle and stopper combination comprising the nozzle as described in any one of the sections 1 to 7, and a stopper, wherein the stopper comprises a fitting engagement sub-region including a contact area with the nozzle, wherein at least a part of the fitting engagement sub-region comprises the fitting engagement region refractory material layer.

Here, "a nozzle located beneath a stopper for controlling a flow rate of molten steel in continuous casting of molten steel, and fittingly engageable with the stopper" typically means a nozzle, called "tundish nozzle" or "upper nozzle" configured such that it is installed in the bottom of a tundish and coupled to another pouring nozzle located therebelow, or an immersion nozzle mounted inside a tundish as with the tundish nozzle or the upper nozzle but typically extending downwardly farther than the tundish nozzle or the upper nozzle and immersed inside a casting mold.

Effect of Invention

The present invention provides a nozzle or a stopper having a gas blowing function, which is capable of preventing irregular breaking to be triggered by a gas outlet or a gas passage path communicated with the gas outlet, or, preventing expansion of the breaking.

The present invention also provides a nozzle capable of, in a case where a refractory material having a higher thermal expansibility than that of the main body refractory material is installed as the fitting engagement region refractory material layer, preventing irregular breaking of the nozzle body.

Further, the carbonless refractory material may be applied as the fitting engagement region refractory material layer. This makes it possible to prevent adhesion of in-molten steel inclusions to the fitting engagement region, and maintain the molten steel flow rate control function for a long period of time.

BRIEF DESCRIPTION OF DRAWINGS

FIGS. 7A-7E are bottom views (conceptually) showing examples of the arrangement of the gas outlet of a stopper according to the present invention.

FIG. 9 is a graph showing air-permeability characteristics in a water model experiment conducted under the condition that the diameter of a through-hole is 5 mm or 2 mm, and the width of a slit is 1 mm.

FIG. 10 is a graph showing the distribution of a gas bubble diameter in the water model experiment conducted under the condition that the diameter of the through-hole is 5 mm or 2 mm, and the width of the slit is 1 mm.

DESCRIPTION OF EMBODIMENTS

Figure 1:
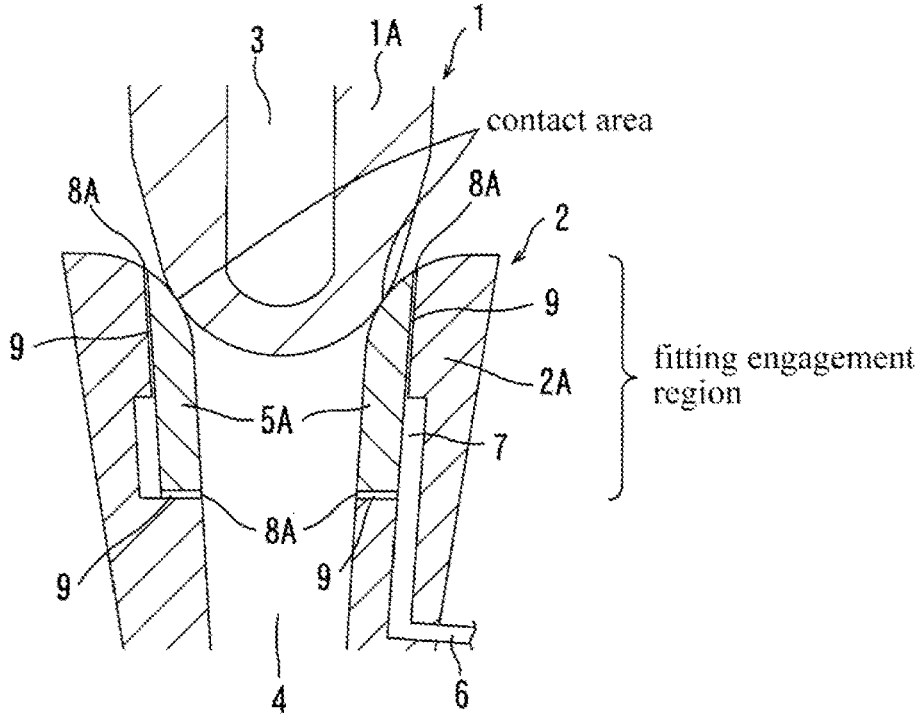
FIG. 1 is an axial (longitudinal) section view showing an example of a nozzle having a gas outlet, together with a stopper fittingly engaged therewith.

Embodiment for implementing the present invention will now be described.

In a fitting engagement region (see, for example, FIG. 1) which is a region including a contact area between a stopper and a nozzle, due to a collision between the stopper and the nozzle caused by an up-down movement of the stopper, vibration of the stopper during pouring of molten steel, etc., and due to vibration of the stopper or nozzle caused by gas when the gas is blown from a gas outlet into molten steel, a mechanical stress arises inside the nozzle and/or stopper.

Further, the fitting engagement region undergoes a large thermal change during pre-heating or start of pouring of molten steel, or due to gas blowing (cooling by blowing gas), so that a thermal stress arises inside the nozzle and/or stopper.

On the other hand, in an area having a boundary which interrupts the continuity of a refractory material composing the nozzle or the stopper (boundary area), a stress is likely to concentrate thereon to trigger breaking of the refractory material.

However, such a boundary area has a stress relaxation function although it is not at a high level.

Heretofore, such a boundary area has been generally formed in the following configurations.

(1) A configuration comprising two discontinuous layers made of the same material. For example, a configuration obtained by: preliminarily producing a shaped body composing a first layer; and charging a mixture for forming a second layer to be in contact relation with the shaped body, thereby producing integrated shaped bodied, or a configuration obtained by integrally fixing two shaped bodies in a state in which they are simply placed in contact with each other.

(2) A configuration obtained by combining two different materials. For example, a configuration obtained by: preliminarily producing a shaped body using one of the materials; and charging a mixture of the other material to be in contact relation with the shaped body, thereby producing integrated shaped bodied, or a configuration obtained by integrally fixing two shaped bodies made of different materials, in a state in which they are simply placed in contact with each other.

(3) A configuration comprising two layers obtained by using the same material or combining different materials, and a layer formed therebetween by using a material different from the two layers, such as mortar.

Here, the two refractory components (shaped bodies) structurally having a boundary area therebetween may be composed of the same or different refractory materials Further, a gas outlet or a gas passage path communicated with the gas outlet is a void, i.e., a defect, in the microstructure of a refractory material, and a stress is likely to concentrate on the defect to trigger braking of the refractory material.

However, such a void has a function of absorbing or relaxing stresses in the microstructure of the refractory material.

Based on the above considerations, in the present invention, the gas outlet triggering further breaking is disposed in the aforementioned boundary area, instead of being disposed in the fitting engagement region between the nozzle and the stopper or a region having a microstructure integral/continuous with the fitting engagement region, which is important in molten steel flow rate control. That is, in the present invention, the boundary area having a stress relaxation function although it is at a low level is overlappingly provided with the gas outlet as a void having a further stress relaxation function. Thus, it becomes possible to further suppress or prevent the occurrence of the breaking or the expansion of the breaking.

Further, a cooling effect by gas blowing from the gas outlet can be expected to provide a secondary effect of suppressing a temperature rise of the refractory material to reduce a stress due to thermal expansion of the refractory material (particularly, an inner bore region or an upper end of the nozzle).

Figure 2:
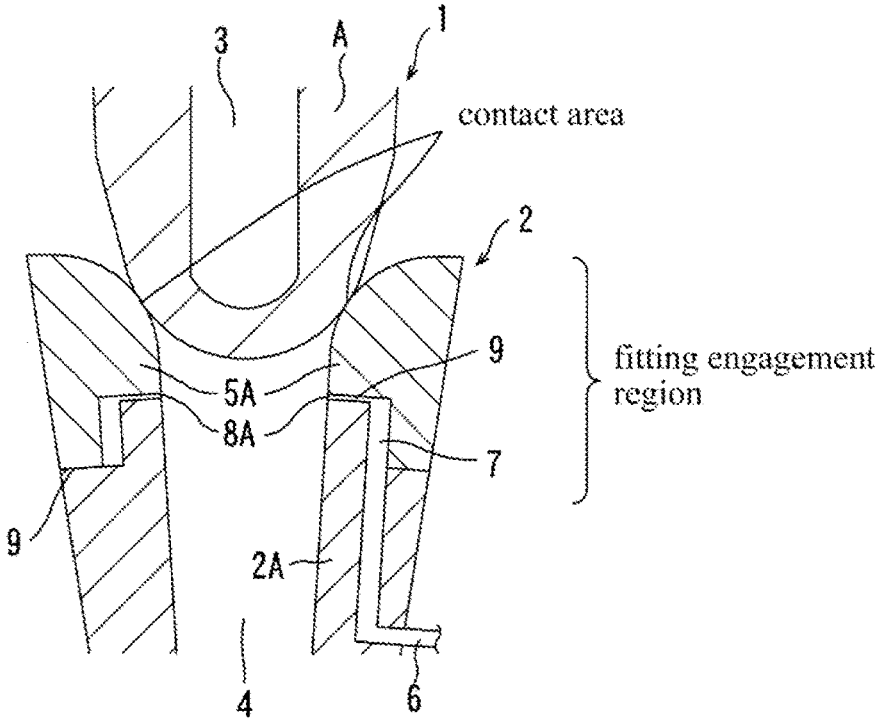
FIG. 2 is an axial (longitudinal) section view showing another example of the nozzle having the gas outlet, together with the stopper fittingly engaged therewith.

In the present invention, for example, in a case where a nozzle 2 as shown in FIG. 2 comprises a cylindrical-shaped fitting engagement region refractory material layer (cylindrical-shaped layer composed of a refractory material for the fitting engagement region) 5A installed around an upper end of an inner bore 4, the boundary area exists on the side of an outer periphery of the fitting engagement region refractory material layer 5A, and on the under side of a fitting engagement sub-region of the nozzle 2 to extend transversely with respect to the inner bore 4 (in a direction approximately perpendicular to a longitudinal axis of the nozzle).

Then, one or each of the two boundary areas 9 may have a gas outlet 8A opened in a surface of the nozzle contactable with molten steel.

Further, for example, in a case where an upper end of a nozzle 2 is formed as a fitting engagement region refractory material layer 5A, as shown in FIG. 2, the boundary area 9 exists on the under side of a fitting engagement sub-region of the nozzle 2 to extend transversely with respect to an inner bore 4 (in a direction approximately perpendicular to a longitudinal axis of the nozzle), and can have a gas outlet 8A opened in a surface of the nozzle contactable with molten steel.

In each of the nozzles 2 illustrated in FIGS. 1 and 2, gas is introduced from a gas inlet 6 and blown from the gas outlet(s) 8A into molten steel via a gas pool 7.

In the present invention, the gas outlet may be composed of a plurality of through-holes or a slit. Although the stress relaxation function slightly varies depending on the number of the through-holes, the size of the through-hole, the size (width) of the slit, or the like, it may be determined according to individual casting conditions, such as balance with the amount of gas.

In the case where the gas outlet is composed of a plurality of through-holes, from a viewpoint of obtaining the stress relaxation function over the entire circumference of the boundary area as uniform as possible, the number of through-holes is preferably set to about eight or more, although it depends on the size of the boundary area.

According to knowledge of the present inventors, the diameter of the through-hole is preferably set to 2 mm or less, and the width of the slit is preferably set to 1 mm or less, from a viewpoint of optimizing a gas bubble diameter of gas in molten steel, which exerts an influence on an inclusion floating effect in a molten steel container or in a casting mold. The reason is that the setting makes it possible to control the amount of blowing of gas with a high degree of accuracy, and to increase the rate of small-diameter gas bubbles (about 3 mm or less) which are likely to facilitate floating of in-molten steel inclusions and less likely to cause steel defect. FIGS. 9 and 10 show results of a water model experiment thereof.

Meanwhile, even when gas is blown into molten steel, in-molten steel inclusions (non-metal inclusions) mainly consisting of alumina adhere to the nozzle or the stopper, in some cases. A region in which such non-metal inclusions exert the largest influence on molten steel flow rate control is the aforementioned fitting engagement region.

Therefore, in the present invention, a refractory material having a carbon content of 5 mass % or less (including zero) (carbonless refractory material) and exhibiting anti-adhesion property against the non-metal inclusions may be installed in the fitting engagement region.

Adhesion of the non-metal inclusions is a phenomenon appearing as a result of a combination of various behaviors arising depending on compositions of a refractory material, and is also dependent on a carbon content in a refractory material contactable with molten steel. The major reason is that carbon is eluted into molten steel at a high speed to coarsen the microstructure of the refractory material.

The present inventors have found that, in a test room and an actual casting operation, an anti-adhesion property of a nozzle is significantly improved by setting a carbon content of a refractory material to be installed in the fitting engagement region, to 5 mass % or less (including zero), i.e., employing a carbonless refractory material as a refractory material to be installed in the fitting engagement region.

The carbonless refractory material may be an alumina-based or alumina-silica based refractory material. However, the present inventors have found that, in a test room and an actual casting operation, a material having: a $ZrO_2$ content of 75 mass % or more, or a spinel ($Al_2O_3 \cdot MgO$) content of 75 mass % or more, and a carbon content of 5 mass % or less (including zero), a remainder mainly consisting of an oxide is more preferably used as the carbonless refractory material.

On the other hand, a main body refractory material composing a nozzle body of the nozzle may be a refractory material primarily comprising a refractory raw material selected from the group consisting of an alumina-based refractory raw material, an alumina-silica based refractory raw material, a spinel-based refractory raw material, a zircon-based refractory raw material, and a magnesia-based refractory raw material. A nozzle, particularly an elongated immersion nozzle, requires high thermal shock resistance. Thus, in the present invention, a material containing a carbon component in an amount of about 12 to 30 mass % may be used as the main body refractory material, as with a commonly-used main body refractory material.

Here, the thermal expansion (about 1.0 to 1.4% at 1500° C.) of the carbonless refractory material is greater than the thermal expansion (in an alumina-based refractory material having a carbon content of 25 mass %, about 0.5 to 0.6% at 1500° C.) of the above main body refractory material. Thus, when the carbonless refractory material is installed on the inner side of or in an upper part of the main body refractory material, and particularly when they are formed in an integral or continuous structure, it is often the case that the carbonless refractory material presses and breaks the main body refractory material.

Therefore, in the case where the carbonless refractory material is applied as the "fitting engagement region refractory material layer", it is preferable to apply the present invention.

The carbonless refractory material (fitting engagement region refractory material layer) may also be provided in at least a part of a fitting engagement sub-region of the stopper to enhance the anti-adhesion function against the non-metal inclusions, or the in-casting mold inclusions floating effect, in the fitting engagement region.

It should be noted that the carbonless refractory material (fitting engagement region refractory material layer) to be applied to the fitting engagement sub-region of the nozzle and the fitting engagement sub-region of the stopper needs not necessarily be the same in terms of composition. For example, as the carbonless refractory material (fitting engagement region refractory material layer), a material "having a $ZrO_2$ content of 75 mass % or more, and a carbon content of 5 mass % or less (including zero), a remainder mainly consisting of an oxide" may be applied to the fitting engagement sub-region of the nozzle, and a material "having a spinel ($Al_2O_3 \cdot MgO$) content of 75 mass % or more, and a carbon content of 5 mass % or less (including zero), a remainder mainly consisting of an oxide" may be applied to the fitting engagement sub-region of the stopper.

Figure 3:
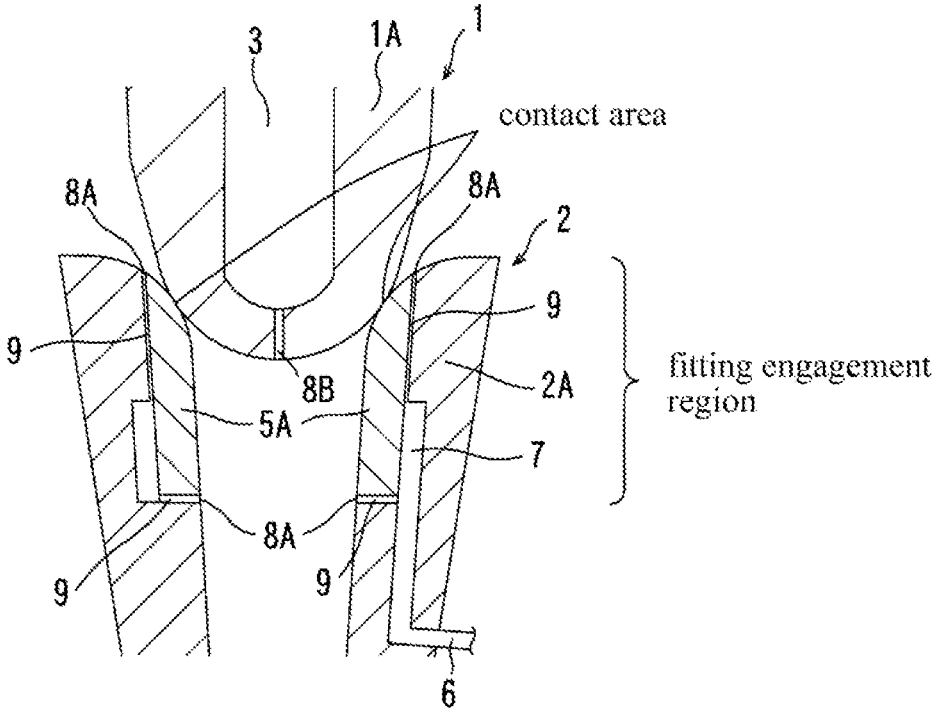
FIG. 3 is an axial (longitudinal) section view showing an example where, in the nozzle and stopper combination illustrated in FIG. 1, one gas outlet is additionally provided at a distal end of the stopper.
Figure 4:
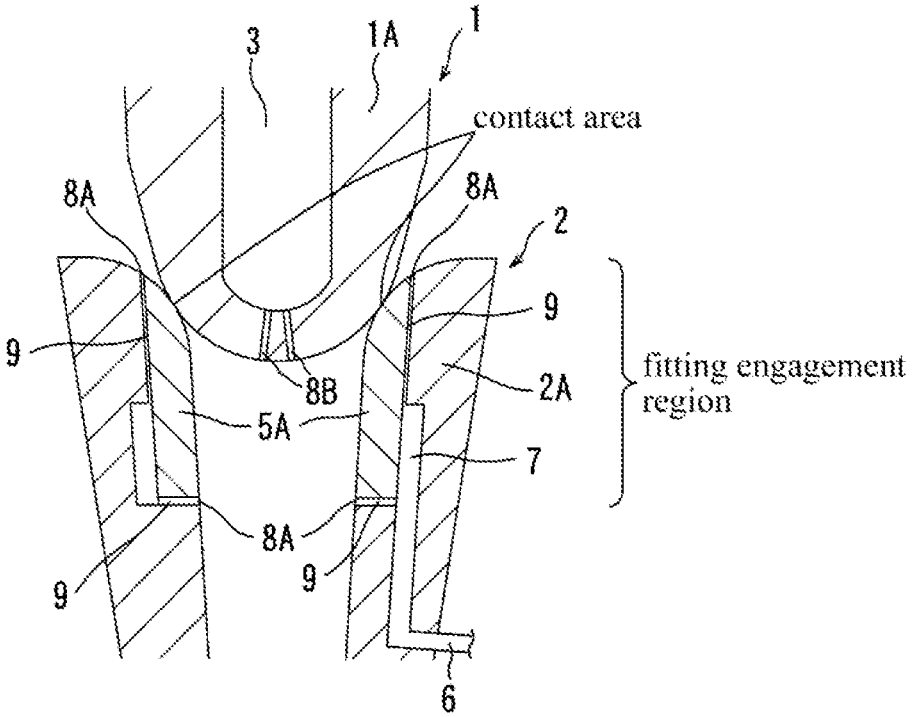
FIG. 4 is an axial (longitudinal) section view showing an example where, in the nozzle and stopper combination illustrated in FIG. 1, a gas outlet composed of a plurality of through-holes or a slit is additionally provided at the distal end of the stopper.
Figure 5:
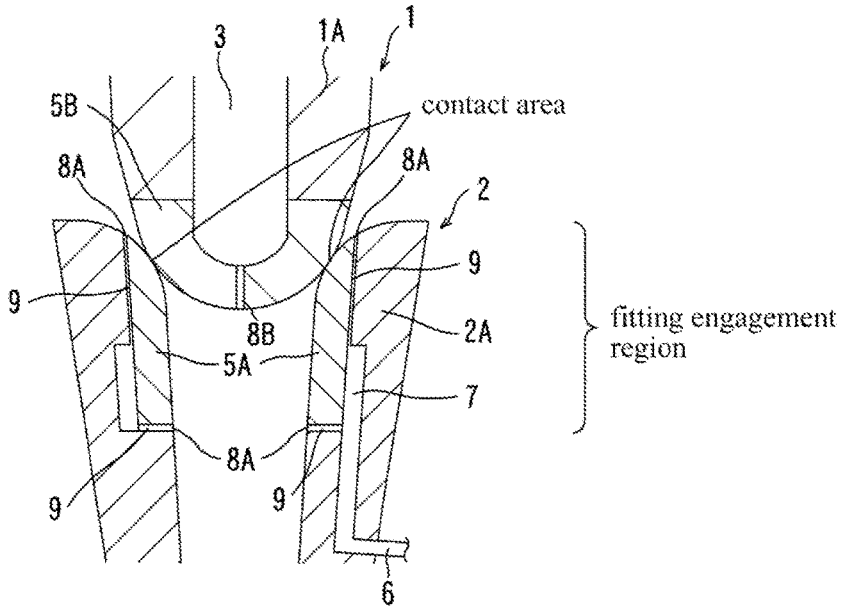
FIG. 5 is an axial (longitudinal) section view showing an example where, in the nozzle and stopper combination illustrated in FIG. 2, a fitting engagement region refractory material layer is additionally installed in a fitting engagement sub-region of the stopper.

In the present invention, for example as shown in FIGS. 3 to 5, each of three stoppers 1 may also comprise one or more gas outlets 8B. Each of the one or more gas outlets 8B of the stopper 1 may be composed of one or more through-holes or a slit provided below a contact area of the stopper 1 with the nozzle 2. In the stopper, the diameter of each of the through-holes is preferably set to 2 mm or less, and the width of the slit is preferably set to 1 mm or less.

Here, in each of the stoppers 1 illustrated in FIGS. 3 to 5, gas is introduced into an inner bore 3 of the stopper, and blown from the gas outlet(s) 8B into molten steel via the inner bore 3.

In the nozzle or the stopper, a portion between respective ones of the plurality of through-holes each serving as the gas outlet may be composed of one of the refractory material for the fitting engagement region (fitting engagement region refractory material) and the main body refractory material. In other words, each of the through-holes may be formed to be in contact with one of the fitting engagement region refractory material and the main body refractory material, or may be formed to penetrate through one of the fitting engagement region refractory material and the main body refractory material, or through a boundary therebetween.

Alternatively, mortar may be provided between the fitting engagement region refractory material and the main body refractory material, and the through-holes may be formed in the mortal.

FIGS. 6A-6D show examples of the arrangement of the gas outlet 8A of the nozzle.

Figure 6A:
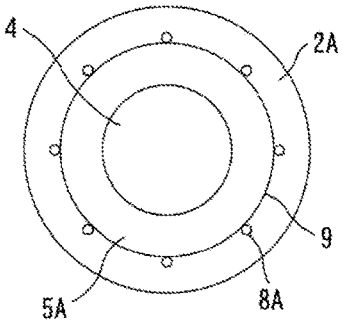
FIGS. 6A-6D are top views (conceptually) showing examples of the arrangement of the gas outlet of a nozzle according to the present invention.

FIG. 6A shows an example where a part of each of a plurality of through-holes 8A on the side of the inner bore 4 is in contact with the fitting engagement region refractory material layer 5A, and the main body refractory material 2A is interposed between any adjacent two of the plurality of through-holes 8A.

Figure 6B:
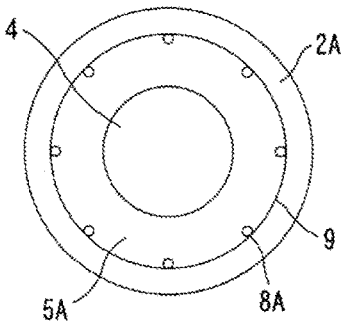

FIG. 6B shows an example where a part of each of a plurality of through-holes 8A on the side of an outer periphery of the nozzle is in contact with the main body refractory material 2A, and the fitting engagement region refractory material layer 5A is interposed between any adjacent two of the plurality of through-holes 8A.

Figure 6C:
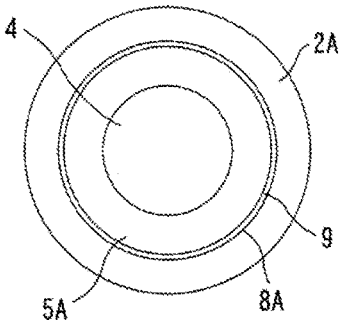

FIG. 6C shows an example where the gas outlet 8A is formed as an approximately continuous annular slit. The term "approximately continuous slit" has been used, because a joining part needs to be partly formed (in a boundary area) between the main body refractory material 2A and the fitting engagement region refractory material layer 5A.

Figure 6D:
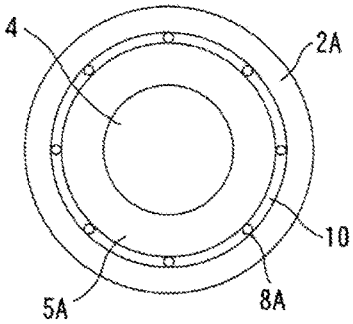

FIG. 6D shows an example where a plurality of through-holes 8A are formed in mortar 10.

FIGS. 7A-7E show examples of the arrangement of the gas outlet 8B of the stopper.

FIG. 7A shows an example where the gas outlet 8A is formed as one through-hole.

FIG. 7B shows an example where a part of each of a plurality of through-holes 8B on the side of the center of the stopper is in contact with a main body refractory material 1A, and a fitting engagement region refractory material layer 5B is interposed between any adjacent two of the plurality of through-holes 8B.

FIG. 7C shows an example where a part of each of a plurality of through-holes 8B on the side of the outer periphery of the stopper is in contact with the fitting engagement region refractory material layer 5B, and the main body refractory material 1A is interposed between any adjacent two of the plurality of through-holes 8B.

FIG. 7D shows an example where the gas outlet 8B is formed as an approximately continuous annular slit. The reason for using the term "approximately continuous slit" is the same as that described above.

FIG. 7E shows an example where a plurality of through-holes 8B are formed in mortar 10.

EXAMPLES

Example A

With regard to a stress relaxation effect in the case where a plurality of through holes are provided in the boundary area between the fitting engagement region refractory material layer (carbonless refractory material) and the main body refractory material, calculation was conducted based on the above findings in a simplified manner by a finite element method. A result of the calculation is shown in Table 1.

In the field "Forming Method" in Table 1, "Integral" means a case where two mixtures of different refractory materials are simultaneously and integrally formed into a single body having a continuous microstructure, and "Segmented" means a case where two segments formed separately are fixed together by a dry joint. The maximum stress index is a value obtained based on the assumption that the maximum stress in Comparative Example 1 is 100. A smaller maximum stress index means a better stress relaxation effect.

TABLE 1

| | Comparative Example 1 | Inventive Example 1 | Comparative Example 2 | Inventive Example 2 |
|---|---|---|---|---|
| Composition of Fitting Engagement Region Refractory Material Layer | Zirconia-based ($ZrO_2$ = 96 mass %, C = 0 mass %) | | | |
| Main Body Refractory Material | Almina-graphite (C = 25 mass %) | | | |
| Forming Method | Integral | Integral | Segmented | Segmented |
| Presence or Absence of Gas Outlet | Without | With | Without | With |
| Configuration of Gas Outlet | — | Through-hole φ2 mm × 8 | — | Through-hole φ2 mm × 8 |
| Maximum Stress Index | 1.0 | 0.8 | 0.6 | 0.3 |

As seen from comparison between Comparative Example 1 and Inventive Example 1, wherein the forming method of them is "Integral", Inventive Example 1 with through-holes is superior in terms of the stress relaxation effect. Further, as seen from comparison between Comparative Example 2 and Inventive Example 2, wherein the forming method of them is "Segmented", Inventive Example 2 with through-holes is superior in terms of the stress relaxation effect.

Example B

Figure 8:
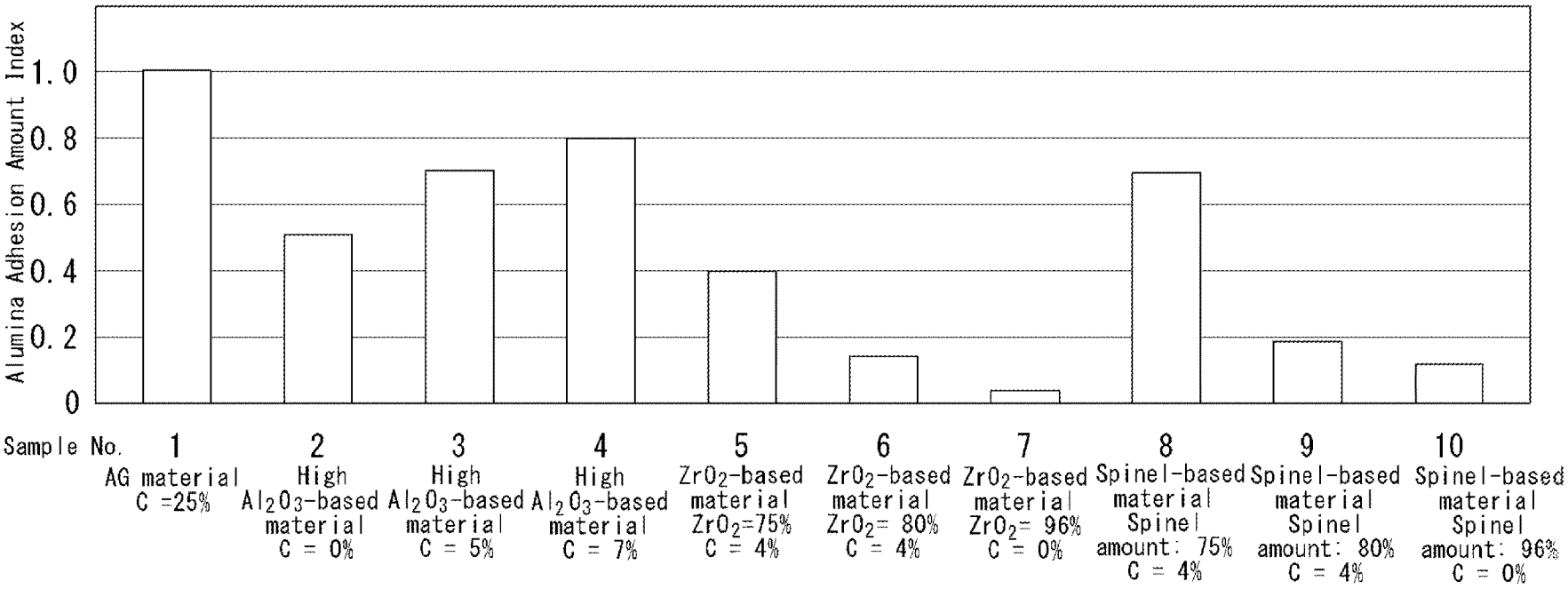
FIG. 8 is a graph showing an example of the amount of adhesion of alumina in each of different refractory materials.

FIG. 8 shows an alumina adhesion amount in each of a plurality of different refractory materials. This is a graph obtained by organizing a plurality of findings in a test room and an actual casting operation.

Here, sample Nos. 2, 7 and 10 contain no carbon.

In FIG. 8, the alumina adhesion amount in each sample is indicated by an alumina adhesion amount index calculated based on the assumption that an alumina adhesion amount in an alumina-based refractory material (also referred to as "AG material") consisting mainly of graphite and having a carbon content of 25 mass % is 1.

FIG. 8 shows that the alumina adhesion amount is reduced in each sample made of a carbonless refractory material. Specifically, a significant alumina adhesion amount reducing effect is found when the carbon content is 5 mass % or less.

FIG. 8 also shows that, in a zirconia ($ZrO_2$)-based material, and a spinel-based material, a significant alumina adhesion amount reducing effect is found when the zirconia or spinal content is about 75 mass % or more, and a more significant alumina adhesion amount reducing effect is found when the zirconia or spinal content is about 80 mass % or more,

LIST OF REFERENCE SIGNS

1: stopper
1A: main body refractory material of stopper
2: nozzle
2A: main body refractory material of nozzle (different refractory material from refractory material for fitting engagement region)
3: inner bore of stopper
4: inner bore of nozzle

5A, 5B: fitting engagement region refractory material layer (carbonless refractory material)
6: gas inlet
7: gas pool
8A, 8B: gas outlet (through-hole or slit)
9: boundary area between fitting engagement region refractory material layer (carbonless refractory material) and the main body refractory material
10: mortar

The invention claimed is:

1. A continuous casting nozzle located beneath a stopper for controlling a flow rate of molten steel in continuous casting of molten steel, and fittingly engageable with the stopper in a fitting engagement region, the nozzle comprising:

a fitting engagement sub-region including a contact area with the stopper, the fitting engagement sub-region comprising a layer composed of a refractory material for a fitting engagement region;

a nozzle body composed of a main body refractory material which is a different refractory material from the refractory material for the fitting engagement region; and a gas outlet provided in at least one boundary area between the fitting engagement region refractory material layer and the main body refractory material in a surface of the nozzle contactable with molten steel, wherein the gas outlet is configured, dimensioned, and arranged to blow an inert gas in a direction along a longitudinal axis of the nozzle.

2. The nozzle as claimed in claim 1, wherein the gas outlet is composed of a plurality of through-holes or a slit.

3. The nozzle as claimed in claim 2, wherein each of the through-holes has a diameter of 2 mm or less, or the slit has a width of 1 mm or less.

4. The nozzle as claimed in claim 1, wherein the refractory material for the fitting engagement region is a low-carbon refractory material having a carbon content of 5 mass % or less (including zero).

5. The nozzle as claimed in claim 4, wherein the low-carbon refractory material has a $ZrO_2$ content of 75 mass % or more and a remainder mainly consisting of an oxide.

6. The nozzle as claimed in claim 4, wherein the low-carbon refractory material has a spinel ($Al_2O_3 \cdot MgO$) content of 75 mass % or more and a remainder mainly consisting of an oxide.

7. The nozzle as claimed in claim 1, wherein the main body refractory material is a refractory material primarily comprising a refractory raw material selected from the group consisting of an alumina-based refractory raw material, an alumina-silica based refractory raw material, a spinel-based refractory raw material, a zircon-based refractory raw material, and a magnesia-based refractory raw material.

8. A nozzle and stopper combination comprising the nozzle as claimed in claim 1, and a stopper, wherein the stopper comprises a gas outlet below a contact area thereof with the nozzle, wherein the gas outlet of the stopper is composed of one or more through-holes or a slit.

9. The nozzle and stopper combination as claimed in claim 8, wherein each of the through-holes of the stopper has a diameter of 2 mm or less, or the slit of the stopper has a width of 1 mm or less.

10. The nozzle and stopper combination as claimed in claim 8, wherein the stopper comprises a fitting engagement sub-region including a contact area with the nozzle, wherein at least a part of the fitting engagement sub-region comprises the fitting engagement region refractory material layer.

11. A nozzle and stopper combination comprising the nozzle as claimed in claim 1, and a stopper, wherein the stopper comprises a fitting engagement sub-region including a contact area with the nozzle, wherein at least a part of the fitting engagement sub-region comprises the fitting engagement region refractory material layer.

* * * * *